US006102228A

United States Patent [19]

Rene

[11] Patent Number: 6,102,228

[45] Date of Patent: Aug. 15, 2000

[54] DEVICE FOR CONNECTING MULTIPLE ISOCONTAINERS

[75] Inventor: Svein Rene, Tönsberg, Norway

[73] Assignee: Uniteam ASA, Olso, Norway

[21] Appl. No.: 09/230,960

[22] PCT Filed: Aug. 5, 1997

[86] PCT No.: PCT/NO97/00198

§ 371 Date: Sep. 22, 1999

§ 102(e) Date: Sep. 22, 1999

[87] PCT Pub. No.: WO98/05574

PCT Pub. Date: Feb. 12, 1998

[30] Foreign Application Priority Data

Aug. 5, 1996 [NO] Norway ..... 963263

[51] Int. Cl.[7] ..... A44B 21/00

[52] U.S. Cl. ..... 220/1.5; 220/23.4

[58] Field of Search ..... 220/1.5, 4.27, 220/23.4, 23.6, 23.83

[56] References Cited

U.S. PATENT DOCUMENTS

| | | | |
|---|---|---|---|
| 3,061,134 | 10/1962 | Fesmire . | |
| 4,136,465 | 1/1979 | Wilson | 220/1.5 X |
| 4,576,300 | 3/1986 | Kedzior | 220/1.5 X |
| 4,819,820 | 4/1989 | Weiner | 2220/23.4 X |
| 5,199,589 | 4/1993 | Noble | 220/1.5 X |
| 5,730,307 | 3/1998 | Karpisek | 220/1.5 X |
| 5,735,639 | 4/1998 | Payne et al. | 220/1.5 X |

FOREIGN PATENT DOCUMENTS

| | | |
|---|---|---|
| 0323623 A1 | 7/1989 | European Pat. Off. . |
| 2657614 A1 | 7/1977 | Germany . |
| 19501423 A1 | 7/1996 | Germany . |
| 2246337 | 1/1992 | United Kingdom . |

*Primary Examiner*—Steven Pollard
*Attorney, Agent, or Firm*—Henderson & Sturm LLP

[57] ABSTRACT

A device for connecting two or more ISO type containers (101, 102). A support (401, 451) is arranged at each container (101*a*, 102*a*) to encircle an equivalent aperture (10) of each container to establish a land surface (402, 452) facing the internal cavity of each respective container (101*a* and 102*a*). The sealing means (201) establishes a continuous sealing extending from said first land surface (402) of said first container (101*a*), across the aperture (10) between the containers and to said second land surface (452) of the second container (102*a*), and along the entire perimeter of the aperture (10) between the containers, and being retained sealingly to said land surfaces (402, 452) by a first and second frame-shaped clamping means (301 and 351). The respective clamping means (301, 351) presses the underlying sealing means (201) towards their respective land surfaces fy fastening means. The device can establish a liquid and gas-tight connection between said first and second container with respect to underpressure or overpressure to the surrounding atmosphere.

6 Claims, 6 Drawing Sheets

DEVICE FOR CONNECTING MULTIPLE ISOCONTAINERS

Figure 1:
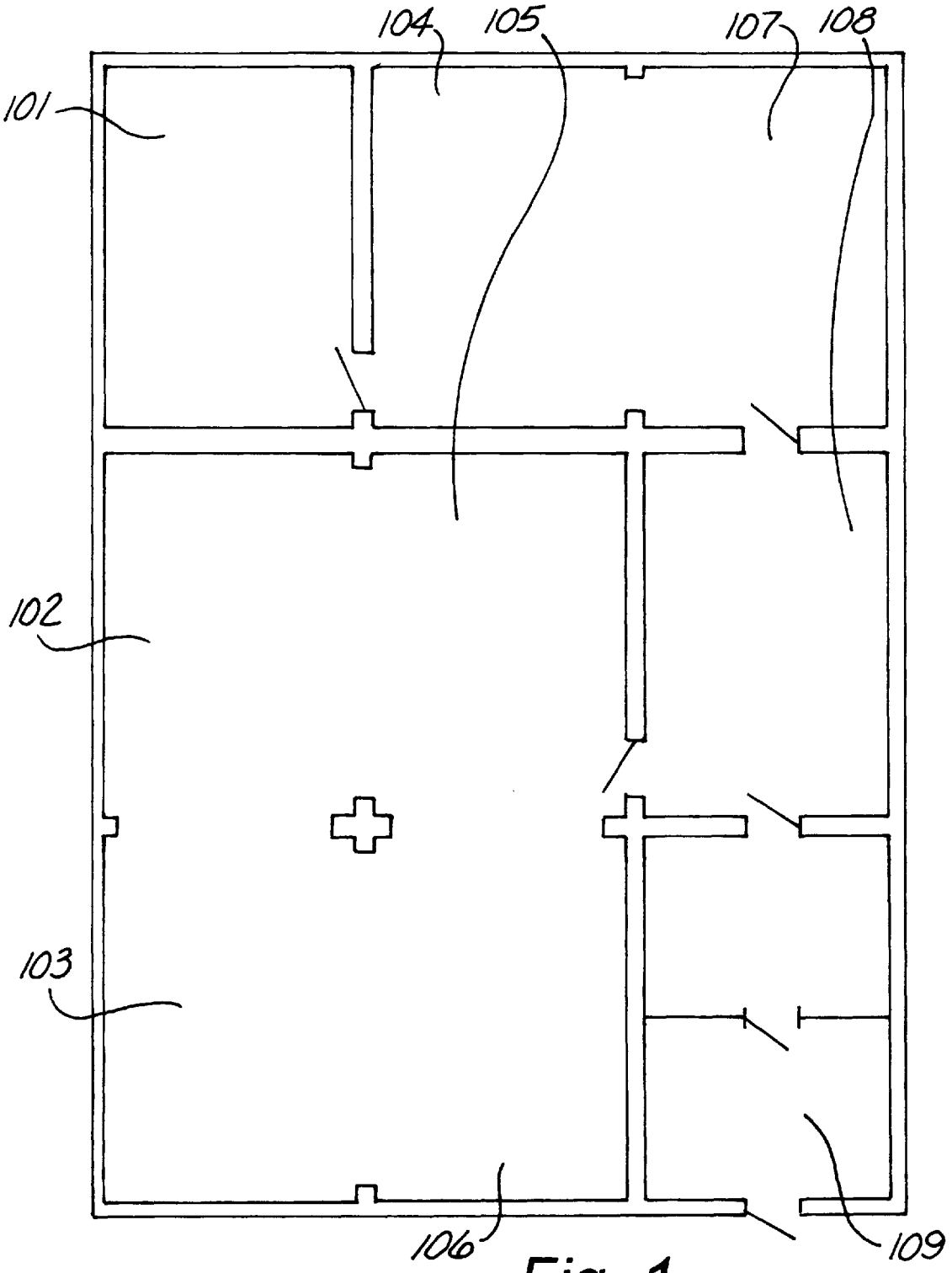

The invention concerns a device for connecting ISO type freight containers, as described in the introductory of patent claim 1 and 6.

BACKGROUND

Freight containers, simply referred to as 'containers', are in extensive use for both civil and military storage and/or transportation of different types of items by sea, train, container trucks or aircrafts etc. The containers are constructed by a framework of steel having a floor, side walls and roof of flat or profiled plates. Usually the containers are provided with swing doors at one of the short ends.

In military applications, containers are used for transportation of equipment such as weapons, clothing, tools etc. from a warehouse to a combat area, where the containers are unloaded when needed and then abandoned. In an attempt to put such containers to further use, efforts have been made to form openings in the container walls to provide doors, windows and similar. However, this solution is not satisfactory for several reasons: firstly, it is not possible to establish a sufficient sealing against gas, and secondly, the containers will no longer be suited to their original purpose unless substantial repair is performed after the containers have served their secondary role.

U.S. Pat. No. 3,061,134 describes a container which has a construction for singular use and for use as a combination of two container units connected end to end. This is obtained by providing an end surface of the container unit with a ribbon-shaped sealing means 35 encircling the aperture of the front door 21 of the container unit. Moreover, the front door exhibits stop means 36 having an extension corresponding to the sealing means to decrease pressing load to the sealing means 35 and to protect the latter from mechanical load both in a mounted situation and in a free-standing situation.

In a connected state, a substantially correspondingly shaped second container unit is guided towards a first container unit to establish surface contact between their respective sealing means 35 and stop means 36. The container units are kept together in such a surface to surface contact by means of locking means 42 arranged at the corners of the aperture, in which the respective locking means 42 in general comprises a bar 43 extending through a bore at the edge of the front door, a locking pin 61 to lock the bolt within the bore including lever 56 to bring the bar 43 from a locked to an open state, and conversely.

Within this construction, the (relatively narrow) sealing 35 is established only at the contacting surface of the respective container units. This design in combination with the stop means 36 requires an exact positioning of the container units in a connecting procedure. Moreover, the combination of the sealing 35 and stop means 36 is not expected to offer a sufficient sealing effect to establish a sufficient overpressure or underpressure within the internal container space. Another substantial difference between this prior art construction from the present invention is that the locking or clamping means 42 exhibits a relatively long physical extension and will therefore extend partly into the aperture established after the connection. Accordingly, a design of this type will strongly limit the possibilities of establishing a free passage, for example, through the connected containers. Moreover, the prior art construction is not at all suited for connecting any form of a connection between more than two containers.

OBJECT

The object of the invention is to provide a device for connecting containers of this type in a convenient and low-cost manner, such that the connected containers are sealed against unchecked interchange of gas/liquid between the internal container space and the surrounding atmosphere.

Another object of the present invention is to provide a device allowing the containers to be used as a transport container device before and after their use as a building.

THE INVENTION

These objects are achieved by a device according to the characterizing part of patent claims 1 and 6. Advantageous features appear from the respective independent claims.

The invention concerns a device for connecting two or more ISO type containers in a horizontal or vertical level, said device comprising:

- a substantially ribbon-shaped elastic sealing means encircling an aperture between the containers to be connected, and is arranged to a land surface, and
- clamping means to force the sealing means to a land surface and to the aperture between the same.

In accordance with the invention the device also comprises:

- a support means arranged at each container and at each aperture in the same to be connected to another container, and is fixed to or integral with each container and encircling the aperture between the same to establish a land surface facing the internal space of the respective container, said sealing means being elongate and being wider than the width of a wall section through two containers and arranged against each other, thus establishing a continous sealing, which, viewed in the lateral cross section of the sealing, extending from the first land surface of the first container, across the aperture between the containers, and over to the other land surface of the other (second) container and along the entire circumference of the aperture between the containers,
- a first and second clamping means, each comprising an integral and substantially frame shaped means, or separate elongate means having at least a substantially level surface, shaped to bear sealingly against an elongate edge of the sealing means arranged against a first and second land surface, respectively, and
- fastening means arranged to force and hold said first and second clamping means towards the respective land surface and establish liquid and gas tight connection between each of the clamping means and land surfaces and thus between the first and second container.

In this way it is possible to establish a container block of two or more containers with a theoretically unlimited size, by a simple means and enables the containers to be used for their intended field of use after use in an assembly according to the invention.

The device in accordance with the invention is applicable to both civil and military use. The invention enables assembly of containers of this type and, for example, establishing a hospital, a workshop or command central, of a practically unlimited size. The assembly principle of the containers also renders it possible to establish overpressure within the building block as a whole, thus supplying sterile filtered air to a operating room via a fan/filter arrangement arranged within or in connection with the container block.

To the contrary, a container block can be provided with an underpressure by means of an accompanying fan/air filter arrangement. In this way it is possible to establish a solitary confinement, for example, for keeping infection sources, such as infected persons from epidemic areas in a simple and low-cost manner. Exchange of infectious patients to and from an isolate block of this type can be done in a convenient manner with a single freight container, shaped in accordance with the invention and provided with a separate fan/filter arrangement to establish underpressure within the same, at connection and disconnection via a lock system connected with the container block shaped with a similar sealing connecting device.

To facilitate grouping and assembly of containers for the intended use, the containers are preferably in advance prepared for a combined use by mounting canal sections for venting, signal and power supply mains etc. These component parts are preferably mounted in accordance with a standarised pattern of different types of modules and are, at the respective ends of each container wall, provided with different coupling means, e.g. plugs, sockets etc. enabling a fast connection of power and signal supply mains and canal mains to a corresponding segment within an adjacent container. These canal sections are arranged to extend through the sealed aperture in adjoining containers.

In order to use the containers for their originaly intended use, i.e. transportation, temporary walls of tear resistant and pressure resistant canvas, for example, may be connected to the open wall sections of the container in question after use.

Figure 2:
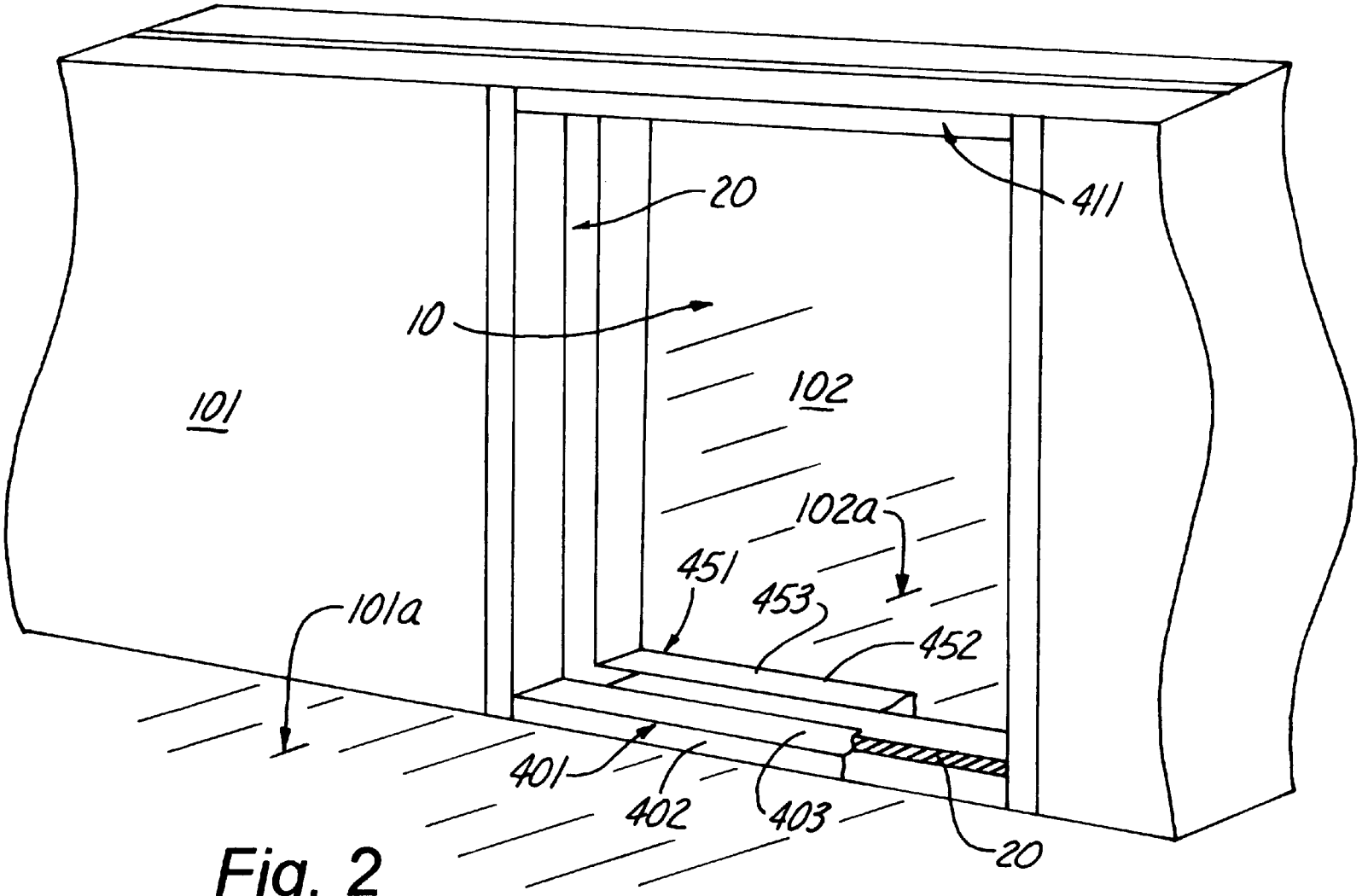
Figure 3:
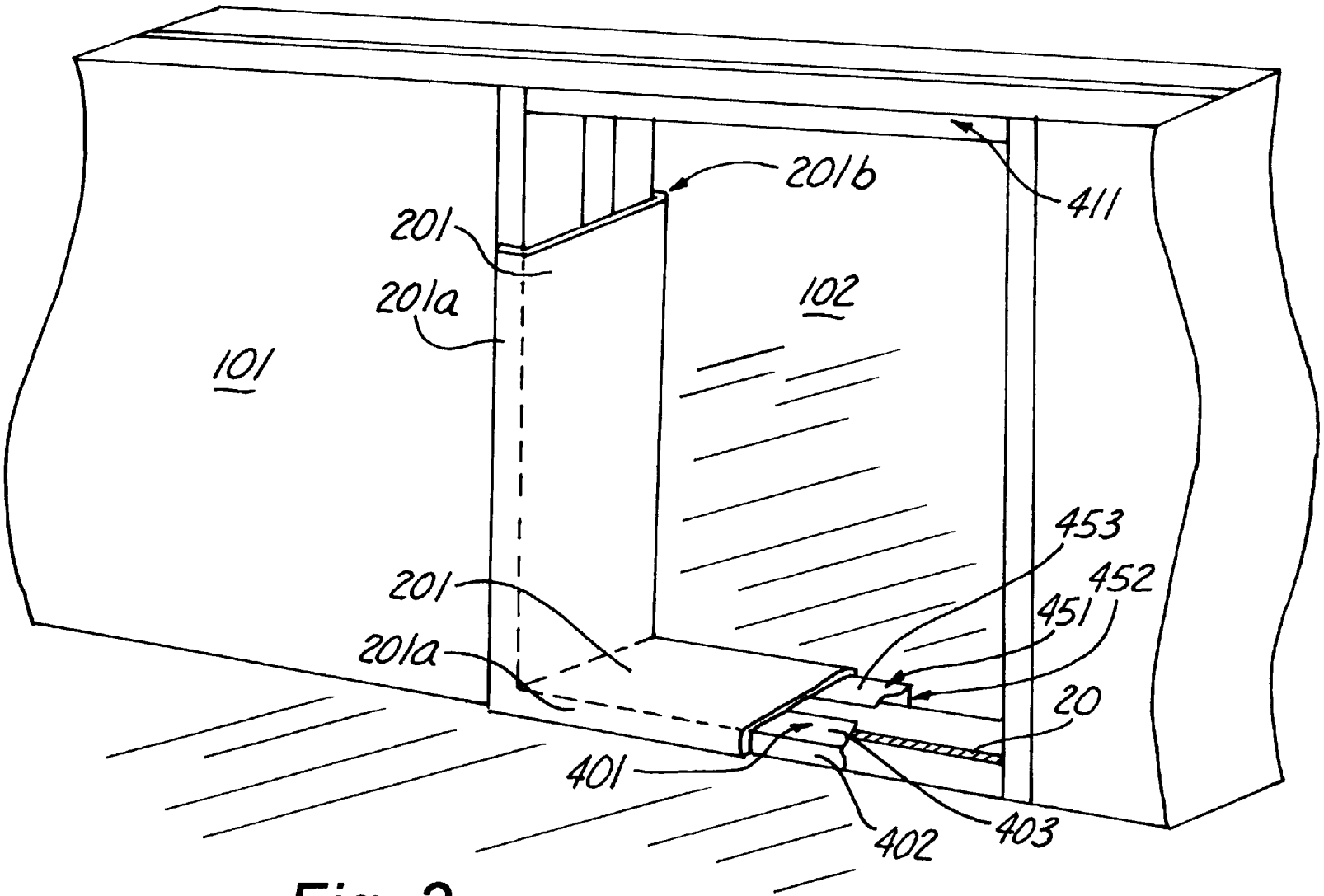
Figure 4:
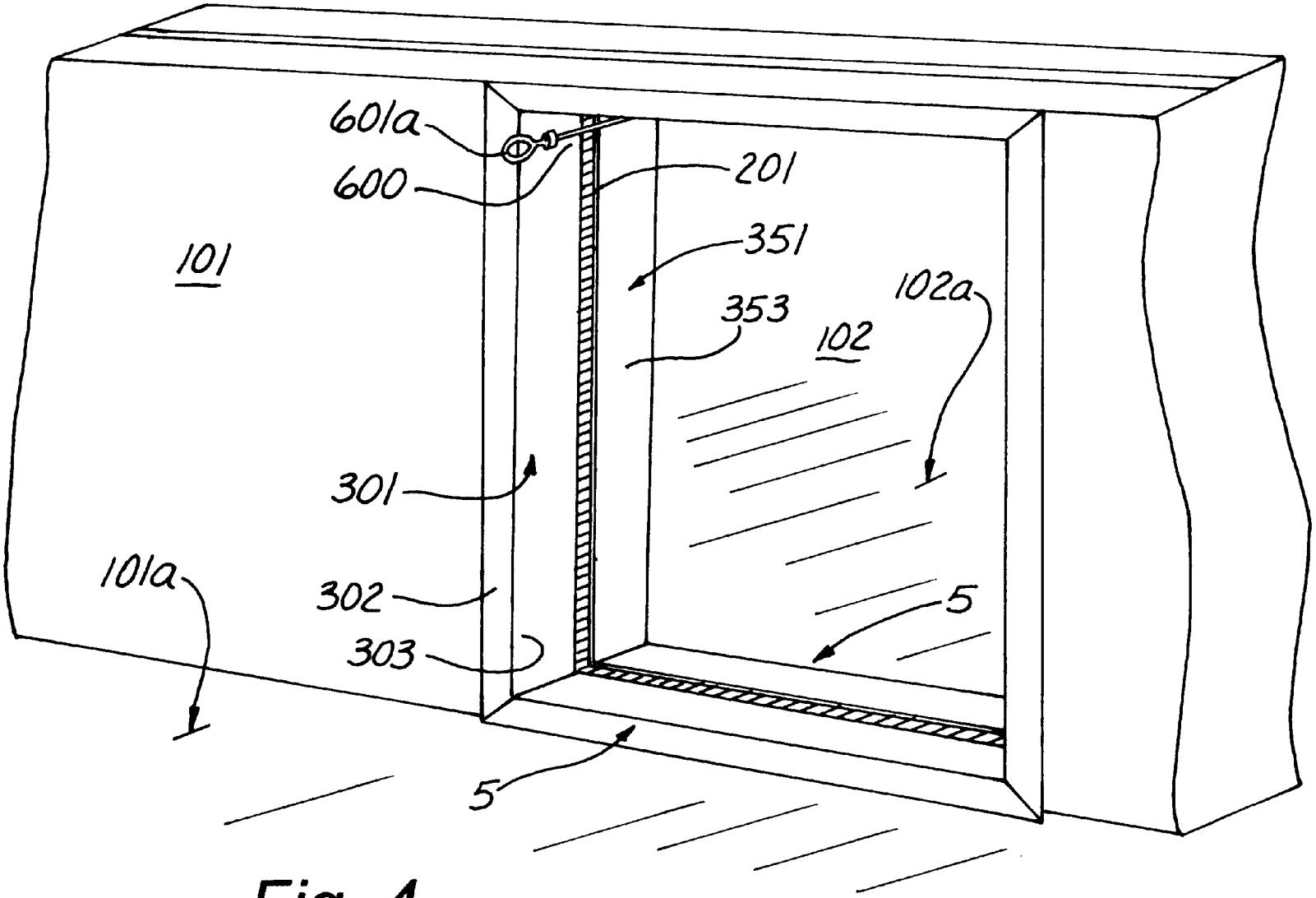
Figure 5:
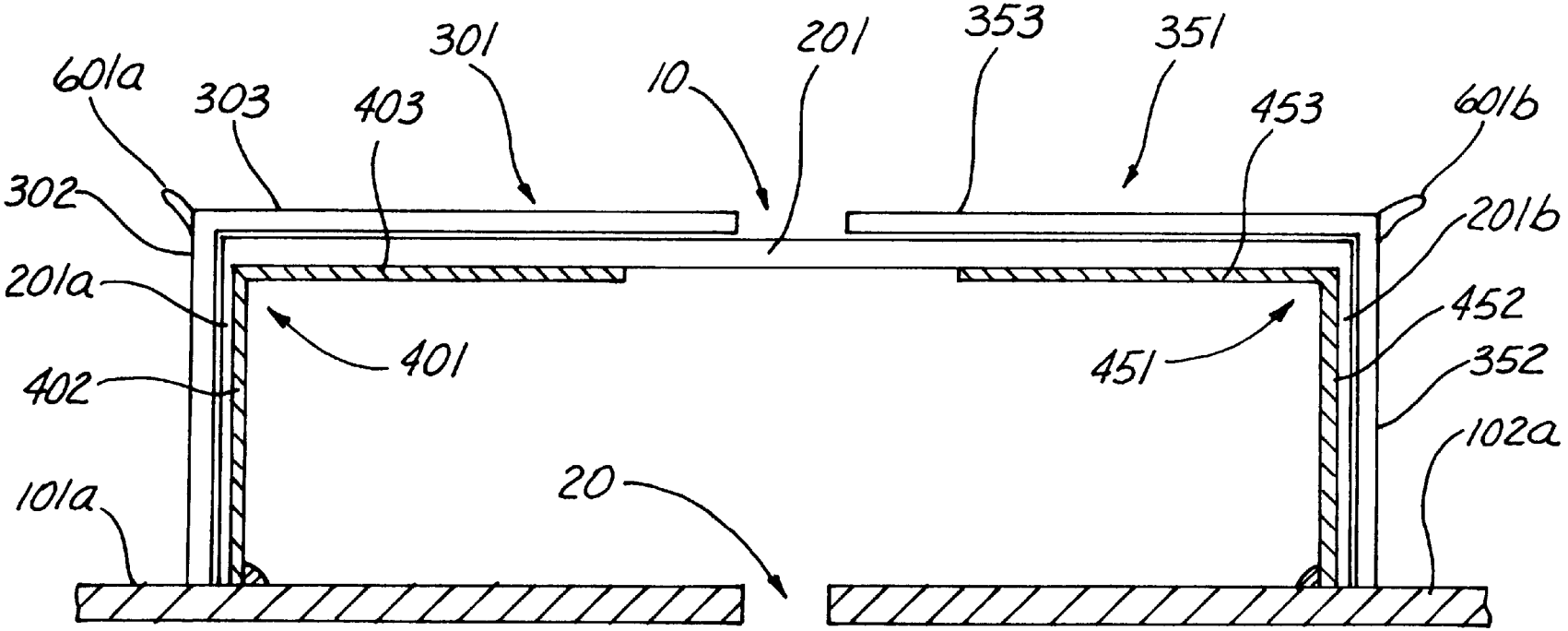
Figure 6:
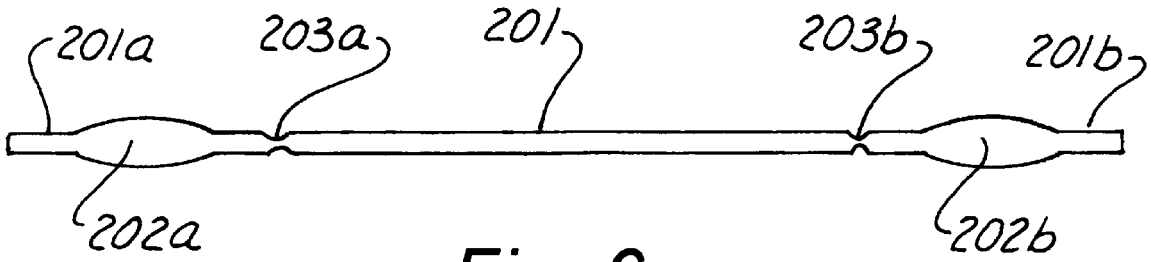
Figure 7A:
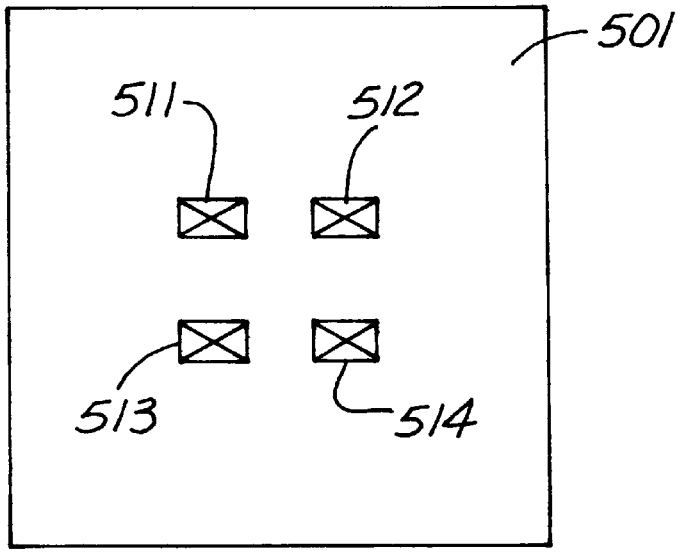
Figure 7B:
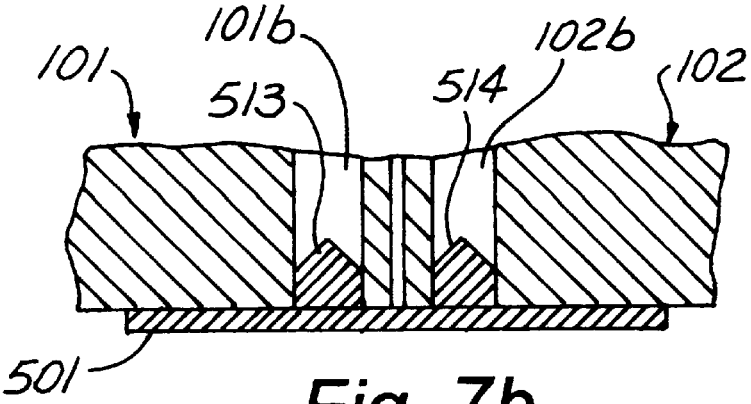

In the following, the invention is described in further detail with reference to a preferred embodiment and by means of figures, in which FIG. 1 illustrates a general sketch of containers connected to a building block, FIG. 2 illustrates a section of a container wall for two containers arranged wall to wall and with recesses for a door viewed in perspective from above, FIG. 3 is a drawing corresponding to FIG. 2, but with a sealing means in accordance with the invention, FIG. 4 is a drawing corresponding to FIG. 3 in which the sealing means is provided with a press/clamping means to seal the construction, FIG. 5 is a sectioned drawing illustrating details of the connection illustrated in FIGS. 2 through 4, FIG. 6 is a sectioned drawing of an alternative embodiment of a ribbon shaped sealing means in accordance with the invention, FIG. 7*a* shows a connecting device viewed from above for connecting 2–4 transportation containers, and FIG. 7*b* illustrates the connecting device of FIG. 7*a* in a cross section in a situation connecting two containers.

FIG. 1 is a drawing showing an imagined building block assembled by means of the device in accordance with the invention formed of a tot of nine freight containers 101, 102, 103, 104, 105, 106, 107, 108 and 109, in which container 109 constitutes the entrance section of the building block. As is apparent from FIG. 1, the room grouping can be selected arbitrarily, and in FIG. 1 there has been established one large compartment of four containers (102, 103, 105 and 106), one some smaller compartment of two containers (104 and 107), whereas the remaining containers each form one single compartment. Admittance to each of the compartments is provided with doors. In this embodiment the building block has been provided with only one entrance door in container 109, and is not provided with any window to the external surroundings. However, it is fully possible to establish a window to the outside environment dependent on the demand and the security requirement in special applications.

FIG. 2 shows a section of a first 101 and a second 102 adjacent container. A recess 10 in the wall is provided to establish a passage between the first and second container 101, 102. The recess can be shaped in, e.g., the shortest container wall, the longest container wall, or within a segment of the same, whereby an opposite container is formed with a recess having a similar size. The floor in the respective containers are indicated at 101*a* for the first container 101 and at 102*a* for the second container 102. The open area between the containers is indicated at 20 and represents the void between adjacent containers to be covered up and sealed with the device in accordance with the invention. The recess 10 is provided with support means 401 arranged at the horizontal lower part of the aperture 10 in the first container 101 and a corresponding support means 451 at the horisontal lower part of the aperture 10 in the second container 102. The lower part of the support means, or the part of the same constituting a part of the container door sill, is preferably countersunk into the container floor to establish an aperture between the containers level with the floor of the same. The support means each exhibit a substantially vertical surface 402 and 452, respectively, extending substantially in parallel with the wall of the respective container 101, 102, and is intended to establish a land surface for the sealing means in a direction towards the internal section of the appropriate container, as is apparent in further detail below in connection with FIGS. 3 and 4. Similar support means are arranged at the side edges of the aperture and at the upper part of the aperture, here—for simplicity—only indicated by numeral reference 411 in the upper part of the aperture of the first container 101, and the support means then forms an internal frame encircling the aperture to be sealed. The support means can be formed by separate modules, or can be formed as a rectangular or square integral frame, and can be connected to the container in any suitable manner, such as with bolts, screws or by welding.

FIG. 3 is a drawing similar to FIG. 2 except that a ribbon-shaped sealing means 201 is arranged onto the joint section in the aperture 10 between the respective containers 101 and 102. The sealing means 201 exhibits a first elongate edge 201*a* and a second elongate edge 201*b*, wherein the first elongate edge is folded about the cornerof the aperture of the first container 101. The second elongate edge 201*b* of the sealing means is similarly folded about the cornerof the aperture of the second container 102, and the central section of the sealing means 201 accordingly covers the cross section surface of the aperture 10 between the containers. As is evident from the figure, the first elongate edge 201*a* of the sealing means 201 rests against the vertical surface 402 of the support means 401. Each of the support means preferably includes a horizontal surface 403, 453 establishing a support surface for the central section of the sealing means 201 to the respective elongate edges to prevent damage to the sealing means. Accordingly, in a connected state the sealing means will embed the doorway completely in both containers. It should be noted that the figure for simplicity shows a partial section.

FIG. 4 shows the fixing of the sealing means illustrated in FIG. 3, in which a first and second clamping means 301 and 351, respectively, comprising a rectangular frame 301 formed of angle steel, for example, has been pressed into the respective surfaces of the doorway. Then a press surface 302, formed by one angle segment within the frame profile extending in parallel with the main level of the frame, rests against the elongate edge 201 a (not seen in FIG. 4) of the sealing means, and a protecting surface formed by the second angle segment 303 of the frame profile extending perpendicularly to the main level of the frame extends into the center of the joint area between the containers. The protecting surface 303 preferably exhibits a width of approximately half the width of the aperture 10 between the containers 101 and 102. Then, when the corresponding clamping means 351 is arranged adjacent to the opposite elongate edge 201*b* of the sealing means, the aperture between the clamping means 301 and 351 will become as small as possible to protect the sealing means 201 against damage and perforation. If necessary, a cover plate (not illustrated) can be inserted in the open area between the clamping means 301 and 351 at the underside of the respective protecting surfaces 303 and 353 and at the external side of the inserted sealing means 201. Fastening means 600 fixed in a first retaining means (not illustrated) is arranged to force the first and second clamping means, respectively, towards each other, whereby the sealing means is jammed between the container wall and clamping means at each side of the doorway. The fastening means can be of any type known per se, to press and retain two items against each other, such as eccentric locks or similar to clamp two separate objects together, and are arranged preferably at each cornerof the clamping means or distributed evenly along the perimeter of the same. However, the fastening means does not have to force the retaining means towards each other; it is also conceivable to use clamping means pressing against the press surface to force the underlying sealing means towards the respective land surface. Then, the sealing means is jammed between the vertical surface 402 (land surface) of the support 401 and the press surface 302 of the clamping means 301. In this way a gas-tight construction is achievable by simple means.

FIG. 5 is a cross-section taken along the line 5—5 of FIG. 4 and shows the floor 101 a of the first container 101 and the floor 102*a* of the second container 102. Angle sections 401 and 451 are fixedly connected to the floor of the respective containers 101 and 102, establishing support for the sealing means 201. The lower part of the land surface 402 and 452 of the respective supports are in this embodiment welded to the floor 101*a* and 102*a* of said first and second container, respectively, by a solid-drawn seam. However, the supports can also be fixed by means of another arrangement, such as bolts or screws. In the latter alternative, a sufficient sealing to gas/liquid will have to be established in the joint between the support and the container. A further description of the construction is set forth below.

FIG. 6 illustrates a cross section of an alternative embodiment of the sealing means 201, in which the respective elongate edges 201*a* and 201*b* are formed with a thickened section 202*a* and 202*b*, respectively, intended to facilitate the sealing between the containers. At the inside of the respective thickened sections towards the center of the sealing means there is established an incision 203*a* and 203*b* facilitating folding of the sealing means about the support 401 and 451, respectively. The sealing means may alternatively be formed with a U-shaped cross section adapted to the external geometry of the support. The sealing means can be provided separately or be integral with the support or the clamping means, and can be formed as a closed loop having dimensions adapted to the aperture to be sealed, or can be cut to a desired length for a subsequent joining, such as vulcanization, in the assembly procedure of the sealing means to the support.

To facilitate assembly, and in particular keep the containers together upon an uneven foundation, the invention also comprises a support plate. FIG. 7*a* illustrates a substantially level support plate, in this embodiment square, provided with four protrusions 511, 512, 513 and 514 arranged about the center of the plate 501. The protrusions exhibit a substantially rectangular cross section and a preferably pointed end. FIG. 7*b* shows the support plate 501 in use arranged under two containers 101 and 102. The protrusions 513 and 514 extend in at least partly into recesses 101*b* and 102*b* formed in the underside of the corner of the respective containers 101 and 102. In use a support plate 501 is located under each of the four comers of a first container having one of its protrusions 511 extending into the recess 101*b* of the underside of the corners of the first container. In the assembly of a second container, the protrusions 514 will first serve as a control or guiding means to guide subsequent containers down upon the support plate and against an existing container. When the subsequent container has been located against the existing container and lowered down upon the protrusions, the protrusions will serve as support or retaining means securing a steady positioning of the containers.

The present invention accordingly provides a device which enables rapid and low-cost establishment of a larger building block, which can be provided with an underpressure or overpressure to the surrounding atmosphere. The flexible sealing connection between adjacent containers also enables the establishment of a building block of this type upon an uneven base.

What is claimed is:

1. A device for connecting two or more ISO type containers in a horizontal or vertical level, said device comprising:

a substantially ribbon-shaped elastic sealing means encircling an aperture between the containers to be connected, and is arranged to a land surface;

fastening means to force the sealing means to a land surface;

a support means is arranged at each container and at each aperture of the same to be connected with another container, and is fixed to or integral with each container and encircling the aperture between the same to establish a land surface facing the internal space of the respective container, said sealing means being elongate and being wider than the width of a wall section through two containers arranged against each other, thus establishing a continuous sealing, which, viewed in the lateral cross section of the sealing, extending from the first land surface of the first container, over the aperture between the containers, and over to the other land surface of the second container and along the entire perimeter of the aperture between the containers;

first and second clamping means, each comprising an integral and substantially frame shaped means, or separate elongate means having at least a substantially level surface, shaped to bear sealingly against an elongate edge of the sealing means arranged against a first and second land surface, respectively; and fastening means arranged to force and hold said first and second clamping means towards their respective land surface and establish a liquid and gas tight connection between each of the clamping means and land surfaces and thus between said first and second container.

2. A device in accordance with claim 1, wherein each clamping means has a rectangular shape and is formed of angle sections.

3. A device in accordance with claim 1, wherein said ribbon-shaped sealing means is formed of a vulcanized rubber material.

4. A device in accordance with claim 3, wherein said sealing means is provided with continuous longitudinal thickenings at said first and second elongate edges, respectively.

5. A device in accordance with claim 1, wherein said sealing means is provided with continuous longitudinal thickenings at said first and second elongate edges, respectively.

6. A device in accordance with claim 1, wherein said fastening means is an eccentric lock.

* * * * *